United States Patent [19]

Rose et al.

[11] 4,436,308

[45] Mar. 13, 1984

[54] BINGO GAME DISPLAY

[76] Inventors: William Rose, 7862 Naylor Ave., Los Angeles, Calif. 90045; David M. Rose, 12849 Via Caballo Rojo, San Diego, Calif. 92129

[21] Appl. No.: 284,251

[22] Filed: Jul. 17, 1981

[51] Int. Cl.[3] ..... A63F 3/06

[52] U.S. Cl. ..... 273/237; 273/138 A

[58] Field of Search ..... 273/237, 138 A; 40/573; 434/112, 113, 114; 340/323 R, 286 M, 331

[56] References Cited

U.S. PATENT DOCUMENTS

| | | | |
|---|---|---|---|
| 3,573,792 | 4/1971 | Reed | 40/573 |
| 3,824,723 | 7/1974 | Gargas | 40/573 |
| 4,080,596 | 3/1978 | Keck | 273/237 |
| 4,095,785 | 1/1978 | Conner | 273/1 GC |
| 4,312,511 | 1/1982 | Jullien | 273/138 A |
| 4,332,389 | 6/1982 | Loyd et al. | 273/237 |
| 4,378,940 | 4/1983 | Gluz et al. | 273/269 |

*Primary Examiner*—Vance Y. Hum
*Assistant Examiner*—Mary Ann Stoll

[57] ABSTRACT

A bingo game display including a display unit having a plurality of lights arranged in a matrix form corresponding to a bingo card, and a control unit coupled to the display unit. The control includes a memory storing information corresponding to a plurality of patterns desired to be displayed, and a pattern selector switch for providing an output for application to the memory corresponding to a desired pattern to be displayed. The memory is responsive at least to the output of the pattern selector switch for supplying an output to the lights in accordance with the pattern selected for enabling energization of the lights according to the pattern selected.

12 Claims, 2 Drawing Figures

BINGO GAME DISPLAY

Figure 1:
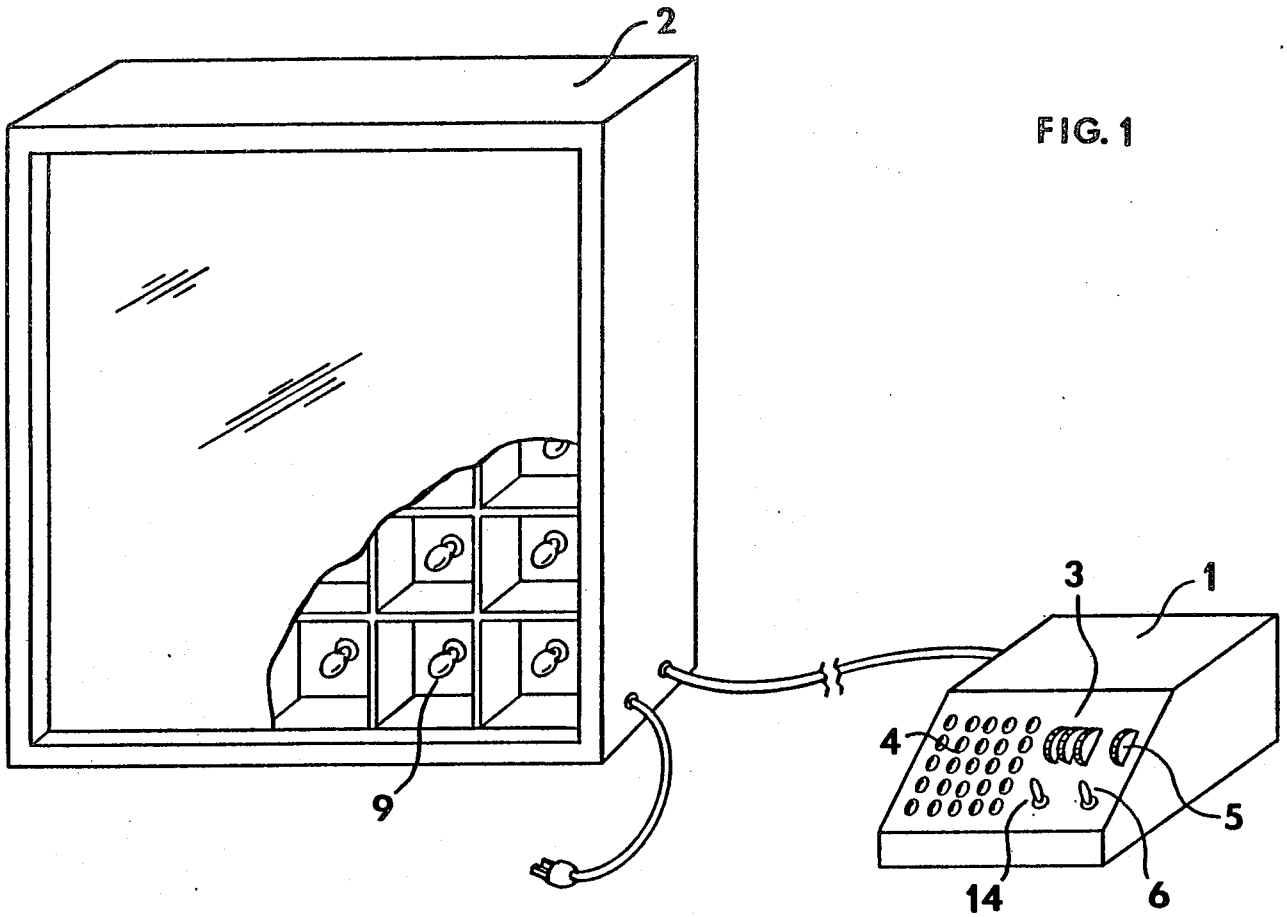

The present invention relates to the game or bingo and, in particular, to a display of a particular pattern or a pattern of a series of patterns required to be achieved for winning the game.

As is well-known, in the game of bingo, a win is obtained by filling a preselected pattern in a 5×5 matrix of squares. In addition to the normal patterns, a type of bingo game requires a preselected pattern to be obtained for winning such game. The preselected pattern game is generally called a "special" game and since many patterns are available for special games, the pattern being played must be displayed. When the game is played in large groups such as by church organizations, clubs and parties, a special game's board is used to display the pattern being played as well as the groups of patterns, for which a winning bingo can be achieved. The special game's board for displaying the various patterns have generally been in the form of large picture cards; as illuminated board with twenty-five switches, one for each of the twenty-five lights which required setting of a switch for each light in the pattern; and an illuminated board with a combination of switches for each pattern and using solenoids wired with parts of patterns for display of a single pattern by closing of an appropriate switch, the latter arrangement being described in U.S. Pat. No. 4,080,596 to Keck et al. Such arrangements, however, have required a plurality of cards, the manual setting of individual switches for each desired pattern, or a complex structure with individual patterns wired differently.

It is, therefore, an object of the present invention to provide an electronic bingo game display capable of displaying a desired pattern of a plurality of stored patterns by means of a single selector switch.

Another object of the present invention is to provide a bingo game display which enables display of a pattern in different positions in sequence (i.e., different patterns), any of the positions being suitable for winning the game.

In accordance with the present invention, there is provided a bingo game display including a control unit with a memory device having stored therein a plurality of patterns desired to be displayed and a selector switch for enabling recall and display of any complete pattern from the memory, and a display board coupled to the control unit having twenty-five lights arranged in a 5×5 matrix, the lights being lighted in accordance with the pattern selected by the selector switch from the memory.

According to another feature of the present invention, a single pattern which may take various positions (i.e., different patterns) for winning a game is stored in the memory in sequence, and a sequencing arrangement is provided for sequencing the patterns to enable display of the pattern in the different positions, the lights of the display board being lighted in accordance with the pattern and position determined by the selector switch and sequencing arrangement. Additionally, by use of a speed selector arrangement, the sequencing can be attained at a fast or slow speed.

Figure 2:
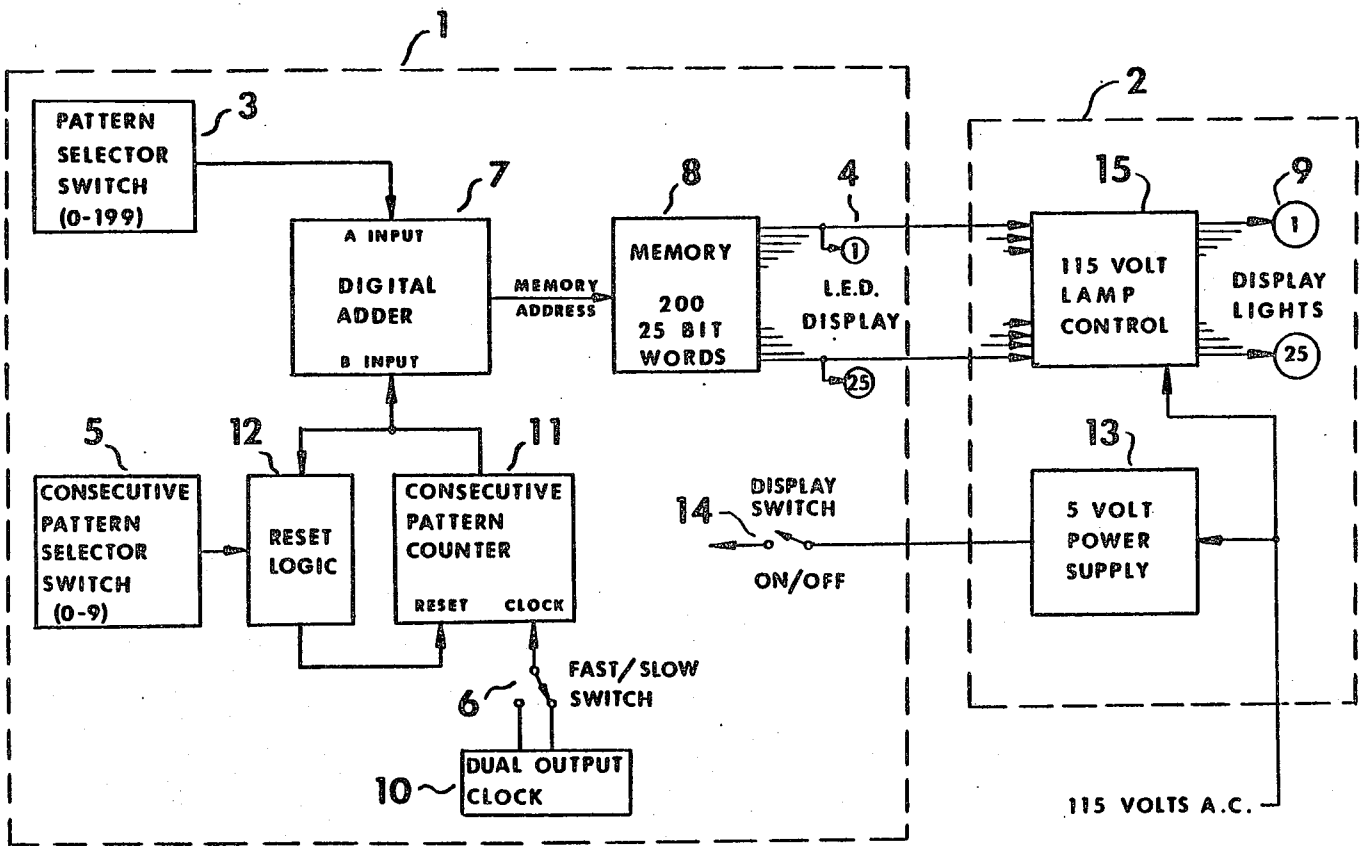

These and other objects, features and advantages of the present invention will become more apparent from the following description when taken in conjunction with the accompanying drawings wherein:

FIG. 1 is a perspective view of the bingo display in accordance with the present invention; and FIG. 2 illustrates in block diagram form the control and display circuitry of the present invention.

Referring now to the drawings wherein like reference numerals are utilized to designate like parts throughout the several views, there is shown a control unit or box 1 connected by cable to a display board 2 which is arranged for connection with a conventional AC source. By use of the control unit 1, the operator can turn on any one of, for example, 200 preprogrammed patterns of the twenty-five lights 9 arranged in a 5×5 matrix in the display board 2 by use of a single selector switch 3. The desired pattern is also displayed by means of an LED display 4 on the control unit. Further, with a second selector switch 5, the operator can cause the patterns to repeatedly cycle through a sequence of consecutive patterns stored in the memory, e.g., 1 to 8 consecutive patterns, so as to display a predetermined pattern in different positions. The switches 3 and 5 may be conventional thumbwheel switches.

The control unit is also provided with a switch such as a two position toggle switch 6 for controlling the time of sequencing of the patterns. That is, the switch 6 is provided with a "fast" or "slow" position and in dependence upon the position of the switch, the length of time that a pattern in the sequence will remain displayed is determined. For example, if the winning special game patterns is a "crazy T" (the letter T in one of the four positions ⊤, ⊣, ⊥, ⊢), the operator would select the pattern number on the selector switch corresponding to the T in the upright position. The operator could then set the consecutive switch to "4" the other three positions of the T being stored in consecutive memory locations after the upright T. The switch 6 is then set for a fast or slow speed and when the display switch 14, such as a two position toggle switch, is turned to the ON position, the electronics of the present invention will cause cycling through the consecutive memory locations to enable continuous display of the "crazy T" in the various positions in sequence at the speed selected.

FIG. 2 illustrates in block diagram form the electronics arrangement of the control unit and display board. As shown, the pattern selector switch 3 provides an output to a memory 8 via the digital adder 7. The operator selects a number from "0" to "199" with the pattern selector switch 3 which number corresponds to one of the preprogrammed patterns stored in the memory 8 desired to be illuminated by selected patterns of lights on the display board 2. The outputs from the selector switch are connected to the "A" input of the digital adder 7 which in turn supplies a memory address to the memory 8. Assuming that the "B" input to the adder is "0," the output of the adder will be identical to the "A" input as determined by the pattern selector switch 3. The memory 8 may be a preprogrammed digital integrated circuit memory such as a read only memory (ROM) or a user programmable memory such as a random access memory (RAM). Although the present invention is described with reference to a ROM having 200 preprogrammed patterns stored therein, it is readily apparent that a larger amount of patterns may be stored or that a RAM may be utilized. The memory 8 in response to the memory address outputted by the adder 7 selects the pattern corresponding to the memory address. The memory 8 provides a twenty-five bit word output for the desired pattern which is a set of twenty-five unique pre-programmed outputs and which is utilized to turn ON or OFF the lights 9 on the display board via the lamp control 15 so as to develop the selected pattern of lights. The output signals provided by the memory 8 are also connected to the LED's 4 on the control unit so that the operator, who may not be in a position to view the display board, has visual confirmation of the pattern selection.

When it is desired to select a number of consecutive patterns which will be repeatedly displayed in a sequential fashion, pattern selector switch 3 is adjusted so select the number corresponding to the lowest desired pattern number (memory address) in the memory 8. The operator then sets the consecutive pattern selector switch 5 on the control unit to the number of patterns desired to be consecutively displayed. In the case of display of the "crazy T" the consecutive pattern selector switch is set to "4." A dual output clock 10 provides two outputs of continual streams of pulses, for example, one output at a rate of one pulse each second and the other output at a rate one pulse every four seconds. By means of the speed selector switch 6, the selected output, i.e., fast or slow, is applied to the clock input of a consecutive pattern counter 11 to control the rate of counting and the rate at which the pattern number (memory address) is changed. The selected signal of one or four seconds per pulse causes the counter to change value at the rate indicated with the counter 11 repeatedly counting from "0" to the number selected by the consecutive pattern selector switch 5. The output from the consecutive pattern switch 5 is connected to a reset logic circuit 12 that compares the output of the counter 11 with the output from the consecutive pattern switch and when the two signals are equal, applies a signal to the reset input of the counter 11 for resetting the counter to "0" whereby the counter begins counting again at the rate determined by the selected output of the clock 10. Thus, the counter output will continuously cycle between "0" and the number selected by the consecutive pattern selector switch 5.

The output of the counter 11 is supplied to the B input of the adder 7. Since the output of the adder 7 develops the sum of the number selected by the pattern selector switch 3 and the output of the counter 11, the sum which is outputted as the memory address to the memory 8 will repeatedly advance one number at a time starting with the number selected by the pattern selector switch 3 and ending with the highest desired pattern number to be displayed in accordance with the consecutive pattern selector switch 5 whereupon the counter will be reset by the reset logic 12 and sequential display of the patterns such as the "crazy T" will continue. In this manner, the various patterns for the "crazy T" will be displayed in sequence without the necessity for setting additional switches or utilizing other display boards for the different patterns.

As illustrated, the display arrangement is arranged for connection with an external source of power as a conventional 60 cycle, 115 volt power supply. The electronics on the control unit may be powered by a 5 volt power supply 13 receiving its power from the external AC power supply. Additionally, the display lights 9 are powered by the AC power supply and may be turned on via the lamp control circuit 15 in accordance with the signals from the memory 8. Thus, the display can be turned off by disconnecting the five volt supply 5 to the control unit utilizing the display on/off switch 14.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

What is claimed is:

1. A bingo game display comprising display means including a plurality of light means arranged in a matrix form corresponding to a bingo card, and control means coupled to the display means, the control means including memory means having stored therein information corresponding to a plurality of patterns desired to be displayed, and a single pattern selector switch means coupled to the memory means for providing an output for application to the memory means corresponding to a desired pattern to be displayed, the memory means being responsive at least to the output of the pattern selector switch means for supplying an output to the light means in accordance with the pattern selected for enabling energization of the light means according to the pattern selected, automatic sequencing means coupled to the memory means for providing an output to the memory means which automatically changes at predetermined intervals, said automatic sequencing means includes a counter means for being set to a predetermined number and for counting up to the predetermined number, consecutive pattern selector switch means for setting the predetermined number into the counter means, and means for varying the predetermined intervals including clock means for supplying clock pulses to the counter means, the counter means counting the clock pulses and supplying an output to the adder means in accordance with the count thereof, said clock means provides clock pulses at a fast and a slow rate, and the means for varying the predetermined intervals includes switch means for selecting one of the fast and slow rate clock pulses for application to the counter means, the memory address supplied by the adder means being changed at the rate of the clock pulses for causing sequencing of the memory means and the display patterns displayed by the light means, said memory means being responsive to the automatic sequencing means for automatically changing the output thereof at the predetermined intervals to energize the light means in accordance with different predetermined pattern according to the outputs of the pattern selector switch means and the automatic sequencing means, and digital adder means for supplying a memory address to the memory means, the digital adder means receiving an input from the pattern selector switch means and an input from the automatic sequencing means for supplying as a memory address the sum of the two inputs, and reset means for resetting the counter means in response to the counter means counting up to the predetermined number, whereby different predetermined patterns are displayed during a game.

2. A bingo game display according to claim 1, wherein the clock means continues to supply clock pulses to the counter means after resetting of the counter means, whereby the sequence of patterns is repetitively displayed by the light means.

3. A bingo game display according to claim 1, wherein the memory means includes a digital integrated circuit memory.

4. a bingo game display according to claim 1, wherein the digital integrated circuit memory is one of a read only memory or a random access memory.

5. A bingo game display according to claim 1, wherein the control means includes a control unit spaced from the display means, the control unit including a miniaturized light display mounted thereon, the output of the memory means being supplied to the miniaturized display for energizing the miniaturized display in accordance with the pattern displayed by the light means.

6. A bingo game display according to claim 5, wherein the miniaturized display is an LED display arranged in matrix form corresponding to a bingo card.

7. A bingo game display comprising display means including a plurality of light means arranged in a matrix form corresponding to a bingo card, and control means coupled to the display means, the control means including memory means having stored therein information corresponding to a plurality of patterns desired to be displayed, and a single pattern selector switch means coupled to the memory means for providing an output for application to the memory means corresponding to a desired pattern to be displayed, the memory means being responsive at least to the output of the pattern selected switch means for supplying an output to the light means in accordance with the pattern selected for enabling energization of the light means according to the pattern selected, sequencing means coupled to the memory means, the memory means being responsive to the sequencing means for changing the output thereof at predetermined intervals to energize the light means in accordance with different predetermined patterns according to the outputs of the pattern selector switch means and the sequencing means, and digital adder means for supplying a memory address to the memory means, the digital adder means receiving an input from the pattern selector switch means and an input from the sequencing means for supplying as a memory address the sum of the two inputs, the sequencing means includes a counter means for being set to a predetermined number and for counting up to the predetermined number, consecutive pattern selector switch means for setting the predetermined number into the counter means, and clock means for supplying clock pulses to the counter means, the counter means counting the clock pulses and supplying an output to the adder means in accordance with the count thereof, and reset means for resetting the counter means in response to the counter means counting upon to the predetermined number, the clock means providing clock pulses at a fast and a slow rate, and switch means for selecting one of the fast and slow rate clock pulses for application to the counter means, the memory address supplied by the adder means being changed at the rate of the clock pulses for causing sequencing of the memory means and the display patterns displayed by the light means.

8. A bingo game display according to claim 7, wherein the clock means continues to supply clock pulses to the counter means after resetting of the counter means, whereby the sequencing of patterns is repetitively displayed by the light means.

9. A bingo game display according to claim 7, wherein the memory means includes a digital integrated circuit memory.

10. A bingo game display according to claim 9, wherein the digital integrated circuit memory is one of a read only memory and a random access memory.

11. A bingo game display according to claim 7, wherein the control means includes a control unit spaced from the display means, the control unit including a miniaturized light display mounted thereon, the output of the memory means being supplied to the miniaturized display for energizing the miniaturized display in accordance with the pattern displayed by the light means.

12. A bingo game display according to claim 11, wherein the miniaturized display is an LED display arranged in matrix form corresponding to a bingo card.

* * * * *